United States Patent [19]

Wallace

[11] Patent Number: 4,944,418

[45] Date of Patent: Jul. 31, 1990

[54] SOFT BABY BOTTLE

[76] Inventor: Kenneth O. Wallace, 862 Inglehart Ave., St. Paul, Minn. 55104

[21] Appl. No.: 370,613

[22] Filed: Jun. 23, 1989

[51] Int. Cl.[5] ..... A61J 9/00; A61J 9/06; A61J 11/04

[52] U.S. Cl. ..... 215/100 R; 215/11.1; 215/11.3; 215/11.6

[58] Field of Search ..... 215/1 C, 12.1, 11.1, 215/11.3, 11.6, 13.1, 100 R; 220/902, 461, 462; D24/47, 48; 248/105, 106

[56] References Cited

U.S. PATENT DOCUMENTS

| | | | |
|---|---|---|---|
| D. 149,108 | 3/1948 | Breslow | D24/48 |
| 1,232,690 | 7/1917 | Keenan | 248/103 |
| 1,753,875 | 4/1930 | Baumann | 248/103 |
| 2,050,622 | 8/1936 | Menk | 248/105 |
| 2,105,835 | 3/1939 | Kazimiro | 215/11.3 X |
| 2,452,749 | 11/1948 | Guden | 215/12.1 X |
| 2,630,932 | 3/1953 | Lestakis | 215/11.1 |
| 2,685,319 | 8/1954 | Swasko | 215/11.6 X |
| 3,342,365 | 9/1967 | Lux et al. | 215/1 C |
| 3,523,026 | 8/1970 | Emerson et al. | 215/11.3 |
| 3,635,431 | 1/1972 | Mariner | 248/104 |
| 3,661,288 | 5/1972 | Noll | 215/11.6 X |
| 3,721,414 | 3/1973 | Yoder | 248/175 |
| 3,790,017 | 2/1974 | Fitzpatrick et al. | 215/11.3 |
| 3,822,806 | 7/1974 | Grimes | 215/11.3 |
| 4,193,506 | 3/1980 | Trindle et al. | 215/11.3 |
| 4,339,046 | 7/1982 | Coen | 215/11.3 X |
| 4,744,476 | 5/1988 | McKee | 215/11.1 |

FOREIGN PATENT DOCUMENTS

| | | | |
|---|---|---|---|
| 799108 | 6/1936 | France | 215/11.1 |
| 1482876 | 6/1967 | France | 215/11.1 |
| 847364 | 9/1960 | United Kingdom | 215/12.1 |
| 2139504 | 11/1984 | United Kingdom | 215/11.1 |

*Primary Examiner*—Sue A. Weaver
*Attorney, Agent, or Firm*—Kinney & Lange

[57] ABSTRACT

A soft, flexible baby bottle is a lightweight, safe device for a baby to drink liquids. The baby bottle has a soft foam elastomeric bottle wall, a disposable bottle liner, a conventional elastomeric nipple, and a seal for attaching the nipple to the bottle wall. The seal also tightly secures the bottle liner between the nipple and the bottle wall. The soft, pliable bottle flexes and absorbs shock if the baby bumps into the bottle.

23 Claims, 6 Drawing Sheets

40'
10'
46'
14
28'
26'
32'
66
62
12
18
16
68
64
24
20

10"

28"
14
26"
70
70
34"
46"
32"
48"
38"
52"
22
70
70
12
24

SOFT BABY BOTTLE

REFERENCE TO OTHER APPLICATIONS

Reference is made to my co-pending application entitled, "Soft Baby Bottle Holder", U.S. application Ser. No. 370,463 filed on even date and pending, and which is incorporated by reference.

BACKGROUND OF THE INVENTION

1. Field of the Invention.

The present invention relates to baby bottles. In particular, it relates to nursing bottles with soft, pliable container walls.

2. Description of the Prior Art.

Many infant nursing bottle inventions are known in the art. Developments in the art have focused on the areas of disposable bottles, bottles with disposable liners and bottle constructions that are both light weight and unbreakable. Other inventions have focused on methods for mechanically supporting a nursing bottle such that a baby can nurse without requiring additional support of the bottle.

The Trindle et al. U.S. Pat. No. 4,193,506 discloses a disposable infant nurser. The infant nurser in one embodiment contains a supply of dry formula. The Emerson et al. U.S. Pat. No. 3,523,026 discloses a nurser having a rigid container with a disposable inner liner. The Lux et al. U.S. Pat. No. 3,342,365 discloses a rigid foam plastic container having at least one impermeable surface for preventing bacterial contamination. Lux et al. provides a bottle that has a combination of rigidity and light weight, and which can be sterilized.

The Keenan U.S. Pat. No. 1,232,690 discloses a bracket for supporting a nursing bottle from a stationary surface such as a chair, table, or crib. The bottle is supported horizontally by a curved metal plate that forms a U-shaped saddle that curves upwardly. The plate is pivotally attached at the base of the curved plate to a vertical support member. The curved metal plate extends approximately half way around the circumference of the cylindrical portion of the baby bottle. A helical spring is connected to each end of the curved metal plate and surrounds the upper portion of the bottle, securing the baby bottle into place. The height of the baby bottle may be adjusted by adjusting the length of the vertical support member. The vertical member is attached to a stationary object such as a chair by a clamping device such as a C-clamp. The entire nursing bottle bracket is rigid.

The Baumann U.S. Pat. No. 1,753,875 discloses a nursing bottle holder that can be mounted to a stationary object such as the side rail of a bed, crib or carriage. Baumann discloses two devices for fixing the bottle holder to a stationary support. The invention also includes a bottle clamp which pivots along the central cylinder axis of the bottle.

The Mariner U.S. Pat. No. 3,635,431 discloses a bottle holder adapted to be secured to the arms of an infant seat comprising a rigid wire having a substantially U-shaped configuration. Each end has a clamp for pivotally attaching the end to an armrest of an infant car seat. The wire has an integrally formed expandable loop located on the central portion of the wire. The expandable loop wraps around a rigid bottle. The bottle holder secures the baby bottle in a position that makes it possible for an infant to nurse without further support of the bottle. The support is adjustable by the infant such that the bottle can be pushed away.

All of the prior art bottle supports are rigid and could potentially cause injury to an infant who drinks from a bottle supported by the devices in a moving vehicle or falls in the direction of the bottle. Although the Mariner U.S. Pat. No. 3,635,431 discloses a holder that can be moved away, the bottle holder is of a rigid construction and could potentially harm an infant.

All of the baby bottle structures disclosed are of rigid construction and pose a hazard when used without assistance or with the bottle holders described above. It would be desirable to have a soft, flexible baby bottle, and a soft, pliable support bracket for feeding a baby in a stationary chair or in a car seat or the like. A soft bottle construction is more easily gripped and is less likely to cause a child injury than a rigid bottle construction.

SUMMARY OF THE INVENTION

The present invention includes a baby bottle having a soft, pliable foam bottle wall, a disposable liner, an elastomeric nipple, and a seal between the nipple and bottle wall. The seal has a first and second sealing surface. The disposable liner has an open end that is positioned between the first and second sealing surfaces, and is tightly held into place. The seal attaches the nipple to the bottle wall and prevents the spillage of liquids.

The bottle wall in the preferred embodiment is formed of polyurethane plastic foam. The foam bottle wall in one preferred embodiment has an impermeable coating on both the interior and exterior surfaces. The bottle wall is soft and pliable. A bottle with a soft bottle construction is easily grasped by an infant and reduces the potential for injury caused by the baby bottle bumping the child.

DETAILED DESCRIPTION OF THE PREFERRED EMBODIMENTS

Figure 1:
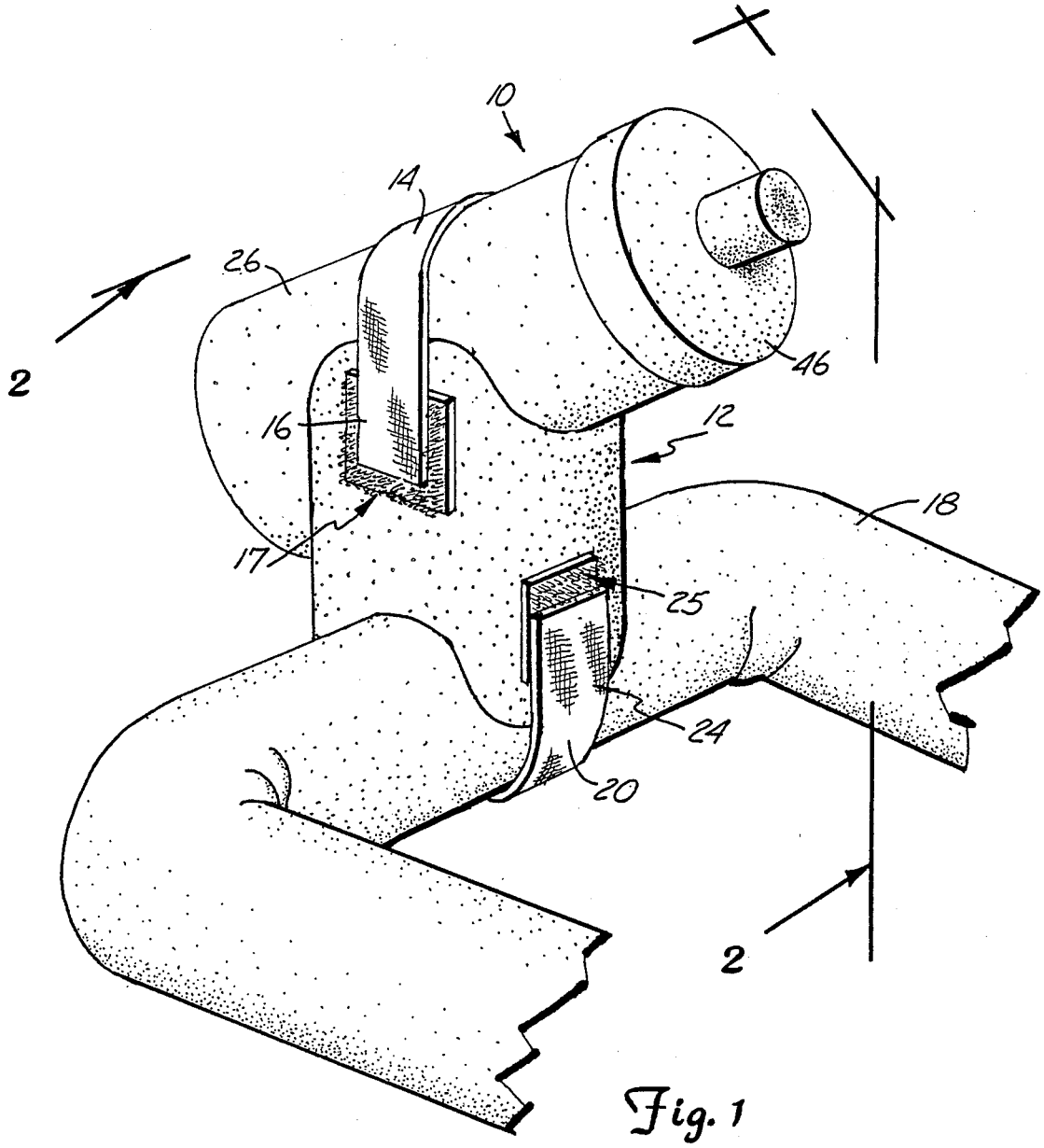
FIG. 1 shows a perspective view of the present invention mounted onto an infant car seat by means of a bottle holder.

A preferred embodiment of a soft, pliable and light weight baby bottle 10 of the present invention is illustrated in FIG. 1. The bottle 10 may be grasped by a child, or placed in a soft pliable bottle holder 12 which is mounted onto a horizontal support member 18 of a typical infant seat.

The bottle holder 12 is used to position the baby bottle on a horizontal support member 18 located forwardly of an infant chair. The horizontal support member 18 typically prevents a child from falling forward in the seat. The bottle holder 12 enables a child to drink without having to support the bottle 10.

The bottle holder 12 is constructed of a flexible foam elastomer and bends if the child bumps the bottle. In the preferred embodiment, the bottle holder 12 is constructed of molded polyurethane foam.

The bottle holder 12 has a first flexible strap 14 which secures the baby bottle 10 to the bottle holder 12. The first flexible strap 14 in the preferred embodiment is constructed of flexible nylon strapping and has a first end (not shown) which is fixedly attached to the bottle holder 12 and a second end 16 opposite the first end. Both the first end (not shown) and the second end 16 are secured to the bottle holder 12 by means of a fastening device 17. In the preferred embodiment, the first end (not shown) of the flexible strap is secured to the bottle holder 12 with an adhesive. The first end (not shown) can also be secured by a hook and loop type fastening device such as a Velcro fastener. Other suitable fastening devices include; a snap, a hook and eye, a button, buckle, sewing the first end onto the bottle holder 12, or any other conventional fastening device.

In the preferred embodiment, the second end 16 is secured to the bottle holder by means of hook and loop type fastening device 17 such as a Velcro fastener. Although the preferred embodiment has a hook and loop type fastener, this invention also contemplates the use of button, hook and eye, buckle, snap, and a variety of other fastening devices for attaching the first flexible strap 14 onto the bottle holder 12.

The bottle holder 12 is secured to the horizontal support member 18 by means of a second flexible strap 20. The horizontal support member 18 may be part of an infant seat, or an infant car carrier, for example. The horizontal support member may also be part of a support bracket (shown in FIG. 7). The second flexible strap 20 has a first end 22 (shown in FIG. 2) and a second end 24 and is attached to the bottle holder 12 at the first end 22 (shown in FIG. 2). In the preferred embodiment, the first end 22 is fixedly attached to the bottle holder 12 with an adhesive. The first end 22 may also be sewn on, or attached with a hook and loop type fastener such as Velcro, a snap, a button, buckle, hook and eye or other conventional fastening device. The second end 24 of the second flexible strap 20 is removably attached to the bottle holder 12 at a point opposite the first end 22. The second end 24 in the preferred embodiment is attached to the bottle holder 12 by a hook and loop type fastener 25 such as Velcro. The second end 24 may also be attached with a hook and eye, a snap, a button, buckle, or other conventional fastener.

Figure 2:
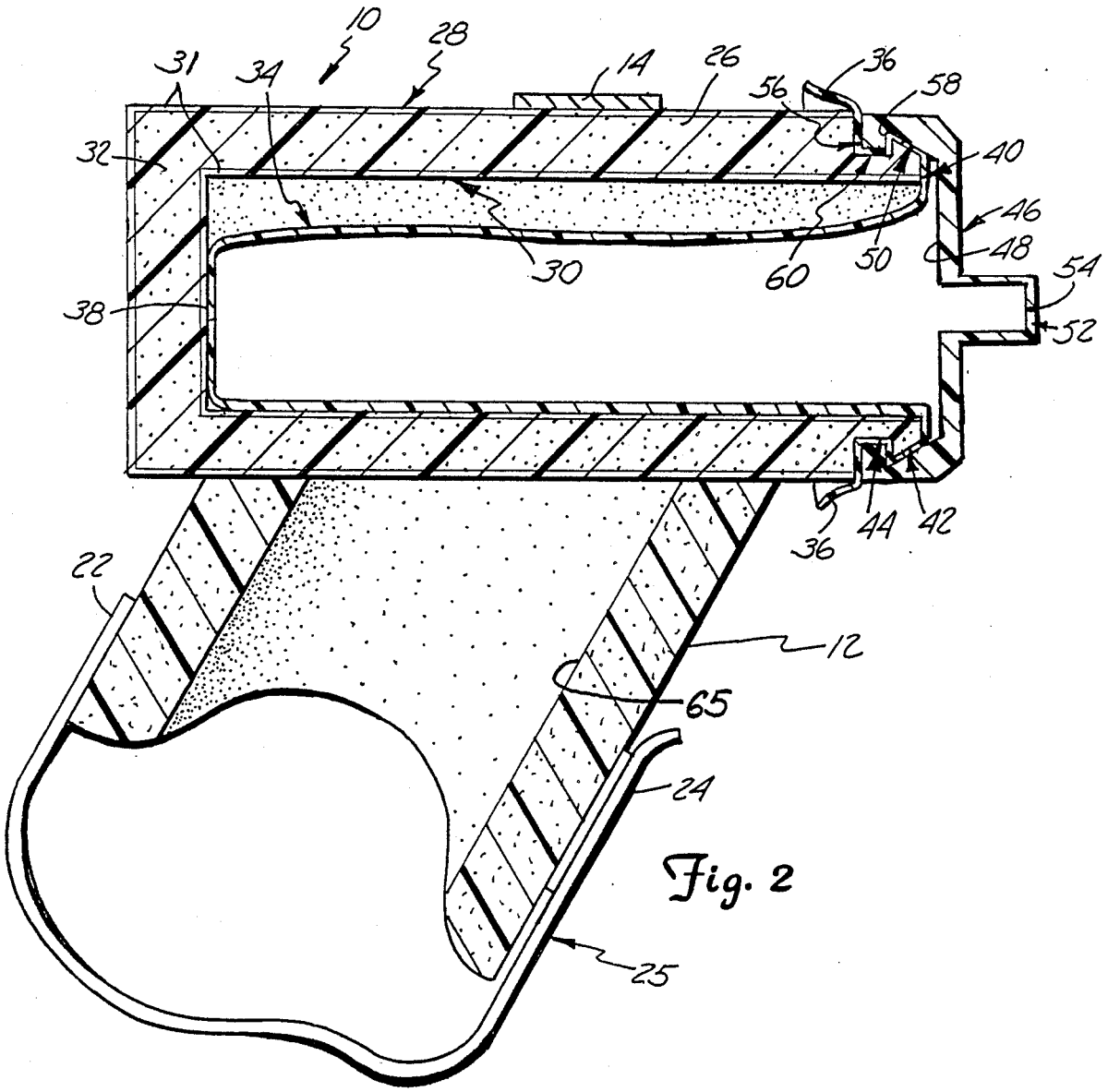
FIG. 2 shows a cross-sectional view of the baby bottle taken along the line 2—2 (shown in FIG. 1).

FIG. 2 illustrates a cross-sectional view along line 2—2 (shown in FIG. 1) of the baby bottle 10 and bottle holder 12. The bottle 10 has a bottle wall 26. The bottle wall 26 is constructed of a flexible, synthetic foam elastomer. In the preferred embodiment, the bottle wall 26 is constructed of foam polyurethane. A wide variety of elastomeric materials in a foamed form are suitable as a material of construction.

The bottle wall 26 has an outer cylindrical surface 28 and an inner cylindrical surface 30. The outer cylindrical surface 28 and the inner cylindrical surface 30 in the preferred embodiment are coated with a thin film of a flexible elastomer 31 to prevent water and contaminants from being absorbed into the foam polyurethane bottle wall 26. In the preferred embodiment, a polyurethane film covers surfaces 28 and 30.

The bottle wall 26 in the preferred embodiment has an integrally molded base 32. In another embodiment, the molded base 32 has an aperture to view the contents of the baby bottle 10. Although the preferred embodiment has a base 32, the invention also contemplates the use of a substantially tubular bottle wall 26 that does not have a base.

The inner cylindrical surface 30 of the baby bottle 10 defines a cavity for holding a disposable bottle liner 34. The bottle liner 34 consists of a plastic bag with an open end 36 and a sealed end 38. The bottle liner 34 is constructed of flexible plastic material. In the preferred embodiment, the bottle liner 34 is constructed of 0.003 inches thick flexible polyethylene.

The bottle wall 26 of the baby bottle 10 has an open end 40. The bottle liner 34 is positioned by inserting the sealed end 38 of the bottle liner 34 into the open end 40 of the baby bottle, and folding the open end 36 of the bottle liner 34 over the open end 40 of the bottle wall 26.

The open end 40 of the bottle wall 26 has a first sealing surface 42. The first sealing surface 42 is a tapered male cylindrical surface that decreases in diameter toward the open end 40. At the base of the first sealing surface 42 is a circumferential groove 44, projecting radially inward from the outer cylindrical surface 28. In the preferred embodiment, the open end 36 of the bottle liner 34 extends over the first sealing surface 42, into the circumferential groove 44, terminating on the outer cylindrical surface 28.

The first sealing surface 42 and circumferential groove 44 in the preferred embodiment are integrally formed in the preferred embodiment as part of the bottle wall 26 to define the open end 40. In the preferred embodiment, the open end 40 is integrally formed from an elastomeric material such as polyurethane plastic. Polyurethane plastic that is not in the foam form is more rigid than the foam elastomer used to form the bottle wall 26, and is more suitable for accepting a conventional elastomeric nipple 46 and for forming a liquid tight seal. Although the open end 40 is integrally molded with the bottle wall 26, it may be formed separately and secured by an adhesive or a heat-sealant, for example.

The nipple 46 may be constructed of any conventional elastomeric material such as rubber or a suitable synthetic substitute. The nipple 46 in the preferred embodiment has an integrally molded inner surface 48 having a second sealing surface 50. The nipple has a tip 52 with a small opening 54 for delivering liquid to the baby. The nipple also has an open end 56 opposite the tip 52.

The second sealing surface 50 is a tapered female inner cylindrical surface located on the molded inner surface 48 which is sized to receive snugly the first sealing surface 42 of the bottle wall 26. The second sealing surface 50 tapers radially outward towards the open end 56 forming an edge 58. Between the open end 56 and the edge 58 of the tapered sealing surface 50 is an inwardly projecting circumferential ring 60. The ring 60 is sized to snugly fit into the circumferential groove 44 of the bottle wall 26. The ring 60 and groove 44 lock the bottle wall 26 to the bottle liner 34, and the bottle liner 34 to the nipple 46.

The baby bottle 10 may be filled by placing the sealed end 38 of the bottle liner 34 into the open end 40 of the bottle wall, and folding the open end 36 of the bottle liner 34 over both the first sealing surface 42 and the circumferential groove 44 of the bottle wall 26. A liquid is poured into the bottle liner 34. The nipple 46 is positioned over the open end 40 of the bottle wall 26 and pressed until the nipple 46 snaps into place.

Although the seal of the preferred embodiment has two tapered locking surfaces, this invention also contemplates the use of first and second male and female threaded surfaces for use with the soft baby bottle.

Figure 3:
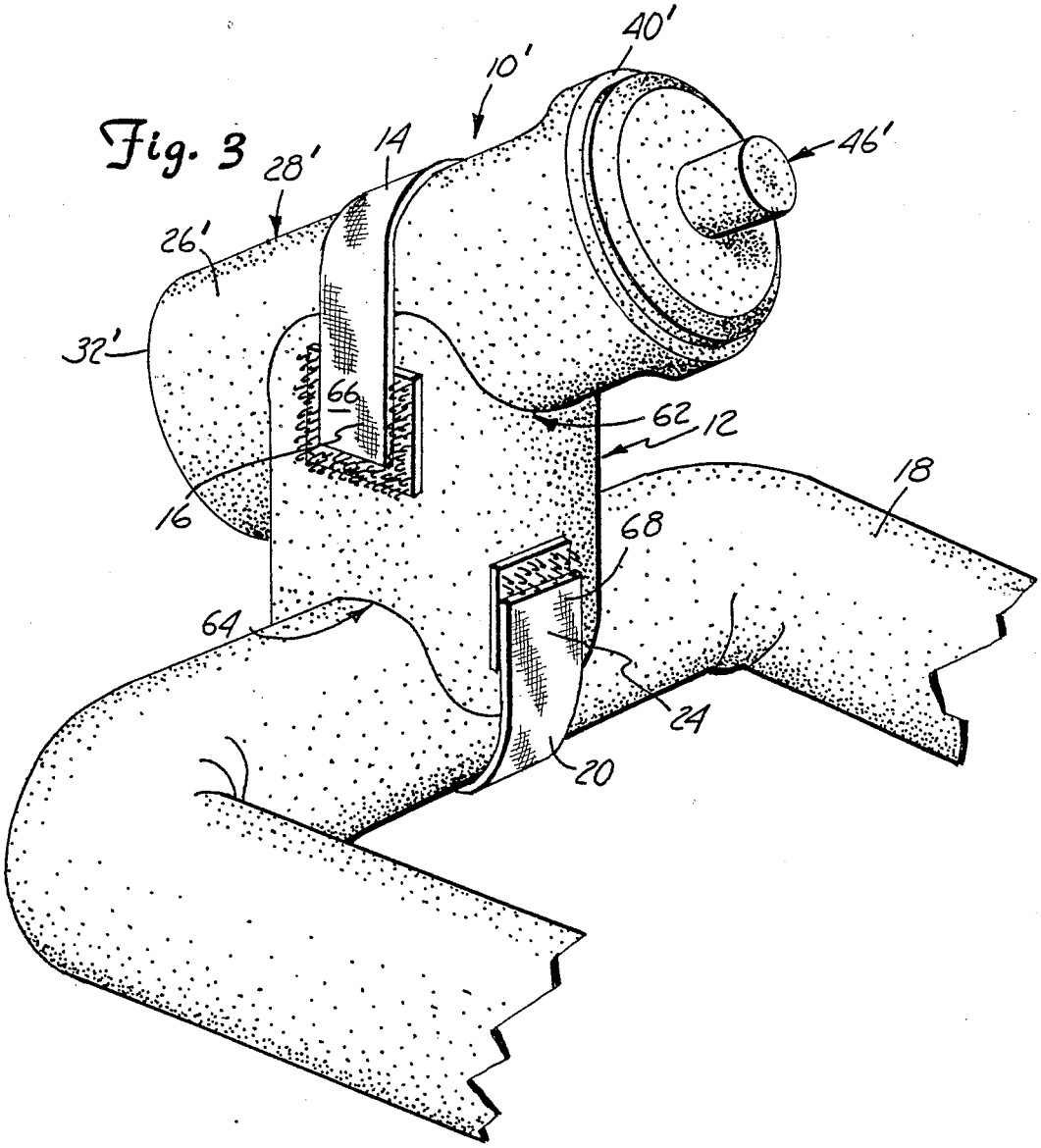
FIG. 3 shows a perspective view of a second preferred embodiment of the present invention, mounted onto an infant car seat by means of a bottle holder.

FIG. 3 illustrates another embodiment of the present invention. The outer cylindrical surface 28' of the bottle wall 26' is of a larger outer diameter at the open end 40' than at the base 32'. The open end 40' is of a larger diameter than the base 32' to accommodate a larger diameter nipple 46'. Similarly, the outer diameter of the open end 40' in another embodiment is of a lesser diameter to accept a smaller diameter nipple 46'.

The bottle holder 12 shown in FIG. 3 is molded into a substantially cylindrical shape. The bottle holder 12 is constructed of a soft, pliable foamed plastic material, such as polyurethane foam. In the preferred embodiment, the bottle holder is approximately six inches high by four inches in diameter by one half inch thick urethane foam. Because the bottle wall 26' and bottle holder 12 in the preferred embodiment are constructed of a flexible foam elastomer, the baby bottle 10' and the bottle holder 12 will flex if the child bumps the bottle 10'. The bottle holder 12 in the preferred embodiment is substantially cylindrical and has a contoured upper edge 62 shaped to snugly receive the baby bottle 10' of the present invention. The contoured upper edge 62 is saddle-shaped to snugly receive the outer cylindrical surface 28' of the bottle wall 26'. Although the upper edge 62 in the preferred embodiment is shaped to receive a cylindrical bottle, other shaped edges are contemplated by the present invention to receive bottles which have hexagonal, oval, and octagonal exterior surfaces, for example.

Similarly, a lower contoured edge 64 of the bottle holder 12 is shaped to snugly receive a horizontal support member 18. The contoured lower edge 64 in the preferred embodiment is saddle-shaped to snugly receive a cylindrical horizontal support member 18. Although the horizontal support member 18 in the preferred embodiment is substantially cylindrical, this invention contemplates the use of support members 18 of a variety of geometric cross sectional shapes including but not limited to rectangular, square, oval, octagonal, hexagonal and triangular. For non-cylindrical horizontal support members 18, the lower contoured edge 64 is shaped to snugly receive the appropriately shaped support member 18.

In the preferred embodiment, the bottle holder 12 has an inner surface 65 defining a cylindrical cavity extending from the upper edge 62 to the lower edge 64 (shown in FIG. 2). In another embodiment, the bottle holder 12 is formed from a solid cylinder of soft, pliable material such as polyurethane foam, for example.

The upper contoured edge 62 of the bottle holder 12 is frictionally locked to the cylindrical surface 28 by wrapping the first flexible strap 14 tightly around the cylindrical surface 28' and locking the baby bottle 10' into place. In the preferred embodiment, the first end (not shown) is fixedly attached to the bottle holder 12 with an adhesive. The first end can also be attached with a hook and loop type fastening device such as Velcro, a hook and eye, a snap, a buckle or any other conventional fastening device. The second end 16 of the first flexible strap 14 is removably locked onto the bottle holder 12 with a hook and loop type fastener 66 such as a Velcro fastener. This invention contemplates the use of a wide variety of fasteners such as snaps, hook and eyes, buttons, buckles, and a wide variety of other conventional fasteners. The friction between the foam outer cylindrical surface 28' and the upper contoured edge 62 prevents the baby bottle 10' from slipping out of the bottle holder 12.

Similarly, the lower contoured edge 64 of the bottle holder 12 is frictionally locked to the outer surface of the horizontal support member 18 by wrapping a second flexible strap 20 around the horizontal support member 18 and tightly locking the bottle holder 12 into place. The second flexible strap 20 has a first end 22 (shown in FIG. 2) and a second end 24. In the preferred embodiment, the first end 22 is fixedly attached to the bottle support with an adhesive. However, any other conventional fastening device such as a snap, hook and eye, by sewing, riveting or button and button hole, for example, would be suitable. In the preferred embodiment, a hook and loop type fastener 68 is used to lock the second end 24 of the strap 20 to the bottle holder 12. This invention contemplates the use of a wide variety of fasteners such as snaps, hook and eyes, buttons, buckles and other conventional fasteners on the second end 24. The friction between the lower contoured edge 64 and the outer surface of the horizontal support member 18 prevents the bottle holder 12 from rotating. It is desirable to tighten the second flexible strap 20 enough to prevent a child from moving the bottle 10 of the present invention.

Figure 4:
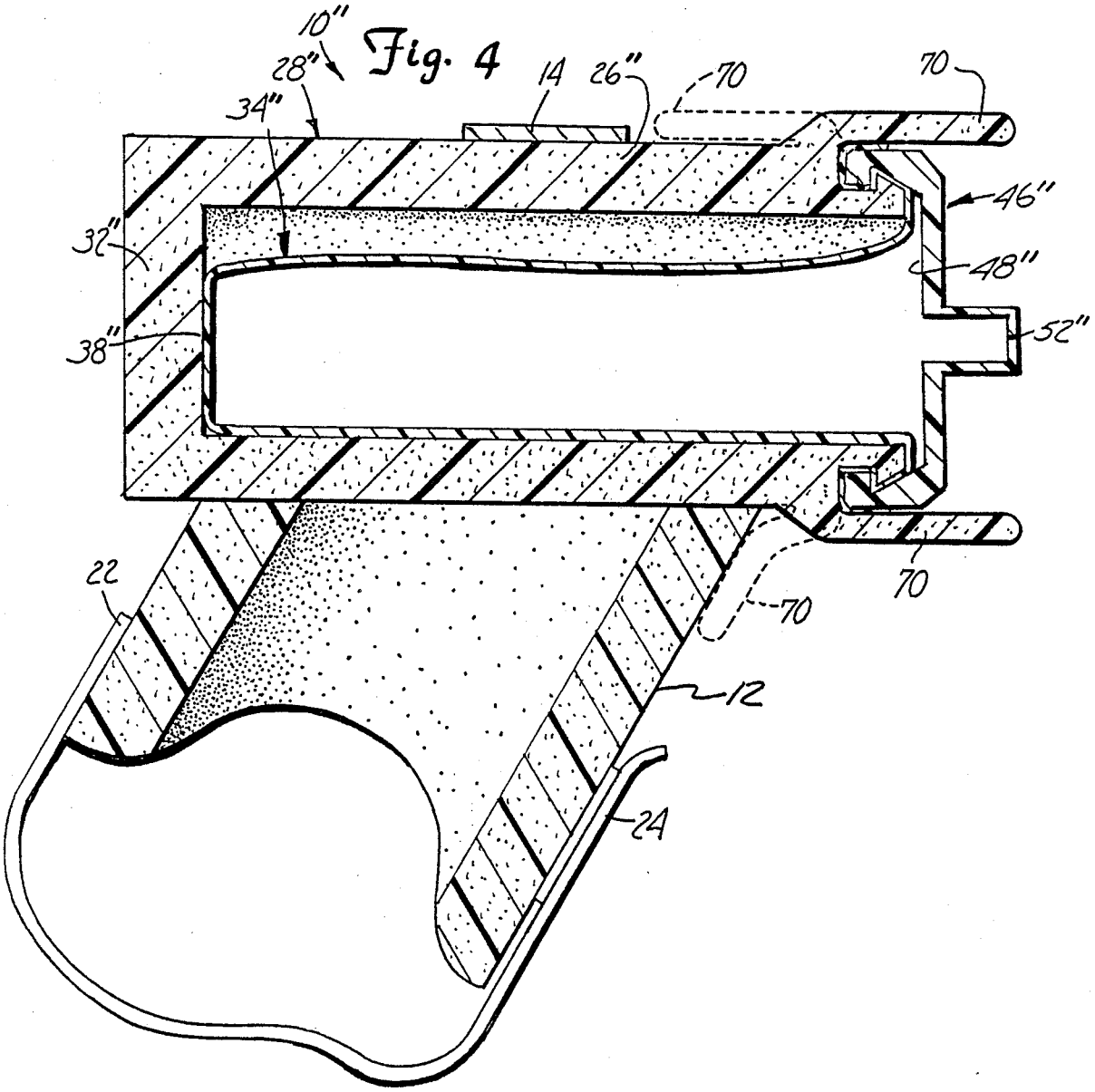
FIG. 4 shows a cross-sectional view of a third preferred embodiment of the present invention.

FIG. 4 illustrates a preferred embodiment of the present invention which incorporates a foldable protective sheath 70, which is integrally attached to the bottle wall 26'. The purpose of the folding sheath 70 is to protect the baby's mouth while feeding in the event that the baby's mouth and the bottle are forced together. For example, if the baby is nursing in a moving vehicle and the vehicle comes to a stop, the protective sheath 70 distributes the force more evenly across the face of the child to minimize injury caused by the force of impact. The folding sheath 70 in the preferred embodiment is constructed of flexible elastomeric foam material such as polyurethane foam and is capable of absorbing shock. The folding sheath 70 in the preferred embodiment is integrally molded with the bottle wall 26''. The sheath 70 may be folded downwardly onto the outer cylindrical surface 28'' towards the base 32'' of the bottle wall 26'' when not in use, as shown in phantom in FIG. 4.

Figure 5:
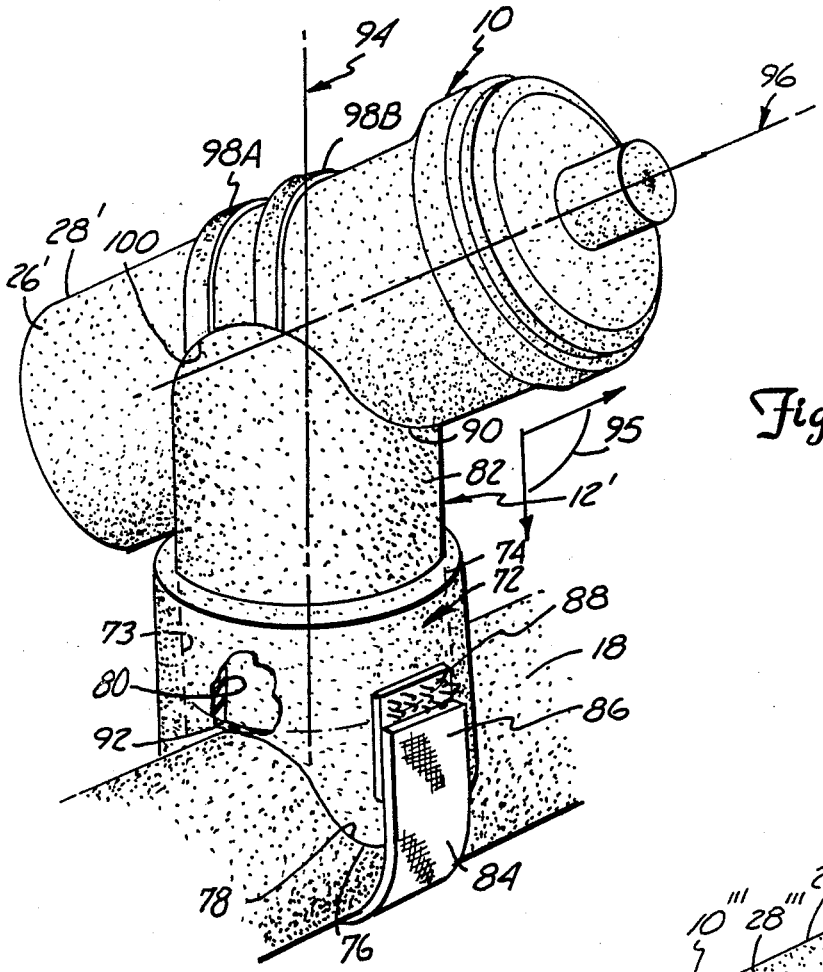
FIG. 5 shows a perspective view of another preferred embodiment of the present invention mounted onto an adjustable bottle holder.

In another preferred embodiment as shown in FIG. 5, the bottle holder 12 is adjustable in height. The bottle holder 12 has a first cylindrical section 72, having a first end 74 and a second end 76 having a contoured lower edge 78. The contoured lower edge 78 in the preferred embodiment is sized to snugly receive the horizontal support member 18. Although the contoured lower edge 78 is saddle shaped to receive a cylindrical horizontal support member 18, the present invention contemplates a contoured lower edge 78 shaped to receive a wide variety of horizontal support member cross-sectional shapes such as square, triangular, or oval, for example. The first end 74 of the first cylindrical section 72 is cut perpendicular to the central axis of the cylindrical section 72 in the preferred embodiment. In another embodiment, the first end 74 is contoured.

The first cylindrical section 72 has an interior cylindrical surface 73 defining a cavity 80 The first cylindrical section 72 is constructed of a foamed, elastomeric material, and is coated on the interior and exterior surfaces with a flexible elastomeric coating which is impermeable to liquids. In the preferred embodiment, the interior and exterior surfaces are coated with polyurethane plastic. Other flexible plastics that are impermeable to liquids would also be suitable coatings.

The first cylindrical section 72 is substantially tubular and has a centrally located cylindrical cavity 80 sized to accept a second cylindrical section 82. The first cylindrical section 72 is secured to the horizontal support member 18 of a typical infant seat by means of a flexible strap 84. The flexible strap 84 in the preferred embodiment is constructed of nylon strapping.

The flexible strap 84 has a first end (not shown) and a second end 86 and is fixedly attached at the first end (not shown) to the first cylindrical section 72 at a point opposite the second end 86. The first end (not shown) in the preferred embodiment is fixedly attached with glue to the first cylindrical section 72. The strap 84 extends around the outer circumference of the horizontal support member 18, and terminates at the second end 86, at a point on the first cylindrical section 72, opposite the first end (not shown). The second end 86 in the preferred embodiment is removably attached to the first cylindrical section 72 by means of a hook and loop type fastener 88 such as Velcro. Both the first end (not shown) and the second end 86 may be attached by other conventional means such as a hook and loop type fastener such as Velcro, hook and eye, button and button hole, by sewing, rivet, etc.

The second cylindrical section 82 has a first end 90 and a second end 92 (shown in phantom). The second cylindrical section 82 is constructed of a foamed, synthetic elastomer such as polyurethane and is sized to fit snugly into the cylindrical cavity 80 of the first cylindrical section 72. In the preferred embodiment, the second cylindrical section 82 is of tubular construction, and has an inner cylindrical surface (not shown) defining a cavity (not shown) extending from the first end 90 to the second end 92 (shown in phantom). In another embodiment, the second cylindrical section 82 is formed from a solid cylinder of flexible, elastomeric material such as foamed polyurethane, for example.

The frictional force between the outer surface of the second cylindrical section 82 and the inner surface 73 of the first cylindrical section 72 holds the second cylindrical section 82 in a preselected position.

The first end 90 of the second cylindrical section 82 is contoured to receive a cylindrical bottle surface 28. Although the first end 90 in the preferred embodiment is saddle-shaped to receive a cylindrical bottle surface 26, the present invention contemplates a first end 90 of any shape which accommodates a variety of bottle shapes, such as a six sided bottle, for example. In another embodiment, the first end 90 is cut perpendicular to the bottle holder axis 94, which extends from a point central to the first end 90 to a point central to the second end 92.

In the preferred embodiment, the angle 95 between the bottle holder axis 94 and the central axis 96 of the baby bottle 10 is at least ninety degrees.

The first end 90 of the second cylindrical section 82 has a pair of straps 98A, 98B fixedly attached to the first end 90 along the outer edge 100. The straps 98A, 98B in the preferred embodiment are formed of flexible rubber. The straps 98A, 98B may also be formed from many other materials such as polyurethane, nylon braided strapping, or cotton braided strapping, for example. The straps 98A, 98B extend upwardly along the outer cylindrical surface 28 of the bottle wall 26 and terminate along the outer cylindrical surface 28. The straps 98A, 98B are removably attached to the outer cylindrical surface 28 of the bottle 10 by means of a hook and loop type fastener (not shown) such as Velcro. Other fastening devices are contemplated by the present invention, such as hook and eye, button and button hole, snaps, and a variety of other conventional fastening devices.

Figure 6:
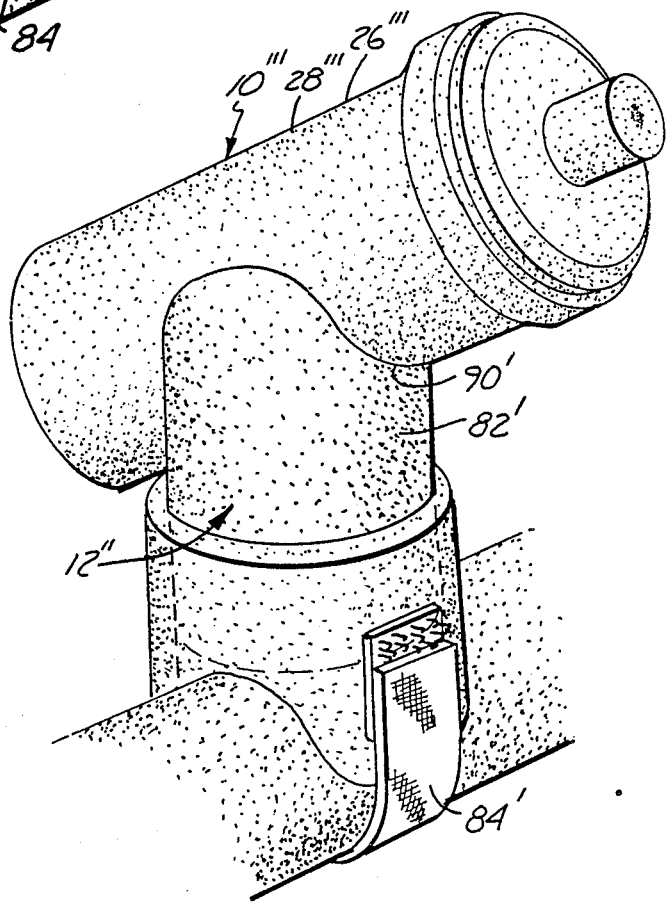
FIG. 6 shows a perspective view of a preferred embodiment of the present invention mounted onto another adjustable bottle holder.

FIG. 6 shows another embodiment of a baby bottle 10''' and adjustable bottle holder 12''. In this embodiment, the first end 90 of the second cylindrical section 82' is contoured to snugly receive the outer surface 28' of the bottle wall 26. In this preferred embodiment, the first end 90' is contoured and is fixedly attached to the outer surface 28''' with an adhesive. Because the second cylindrical section 82' is permanently attached to the bottle wall 26''', it is not necessary to provide straps, or other removable means for securing the bottle 10''' to the bottle holder 12'''.

In yet another embodiment, the bottle holder 12 is of two piece construction, and has a strap attached to the outer surface of the second cylindrical section 82, in a manner similar to that shown in FIGS. 1–3.

Figure 7:
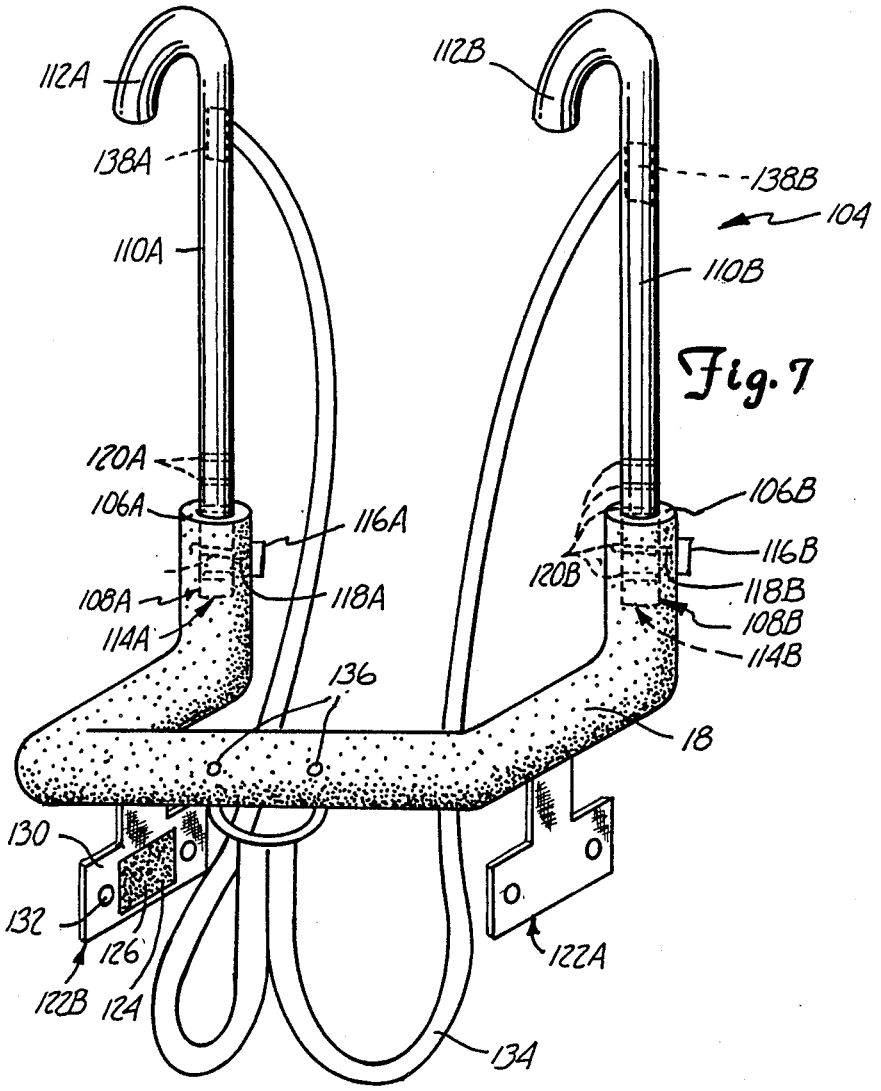
FIG. 7 shows a perspective view of a support bracket for supporting the bottle of the present invention in combination with a bottle holder.

FIG. 7 is a perspective view of the support bracket 104 which may be used in combination with a bottle holder and the baby bottle of the present invention. This bracket 104 is used with the bottle 10 (not shown) and the bottle holder 12 (not shown) when an infant chair lacks a front horizontal support of its own. The purpose of the bracket 104 is to provide a horizontal support member 18 to support the baby bottle 10 and the bottle holder 12 (shown in FIGS. 1–4). The support bracket 104 has a substantially U-shaped horizontal support member 18.

The horizontal support member 18 curves upwardly forming first and second ends 106A and 106B. In the preferred embodiment, the horizontal support member 18 is of tubular aluminum alloy construction. The horizontal member 18 is coated with a urethane foam padding of at least ½ inch thickness to protect an infant from injury. The padding in the preferred embodiment is covered with upholstery material such as vinyl. Each end 106A, 106B has a cylindrical cavity 108A, 108B for receiving a pair of vertical support members 110A, 110B. When the support bracket 104 is strapped onto an infant chair, the vertical support members 110A and 110B are located rearwardly of the chair. In the preferred embodiment, each vertical support member 110A, 110B is substantially cylindrical, and has an upper end 112A, 112B which is U-shaped, forming a hook to wrap over the top of an infant chair.

In the preferred embodiment, vertical members 110A, 110B are constructed of a hard rubber elastomer. Other semi-rigid elastomeric compounds would also be suitable for this use. In another embodiment, the vertical members 110A, 110B are constructed of a tubular metal material such as aluminum, stainless steel, or other alloy.

Each vertical support member 110A, 110B has a lower end 114A, 114B which is substantially cylindrical and is sized to insert into the cylindrical cavity 108A, 108B of the first and second ends 106A, 106B of the horizontal support member 18. In the preferred embodiment, each vertical support member 110A, 110B is secured to the horizontal support member 18 by means of a locking pin 116A, 116B. The horizontal support member 18 has openings 118A, 118B to accept the pins 116A, 116B. In addition, each vertical support member 110A, 110B has a plurality of horizontal through-bores 120A, 120B approximating the diameter of the pins 116A, 116B.

The pins 116A, 116B are inserted through the openings 118A, 118B in the horizontal support member 18 and through one of the horizontal through-bores 120A, 120B for locking each vertical support member 110A, 110B to each end 106A, 106B of the horizontal support member 18. By selecting the horizontal through-bore 120A, 120B, the length of the vertical support members 110A, 110B, is adjusted to fit any height infant seat. Similarly, by selecting the size of the horizontal support member 18, the support bracket 104 is formed to fit any width infant seat.

In the preferred embodiment, a pair of inverted "tee" supports 122A, 122B are positioned downwardly of the horizontal support member 18, on either side. The tee supports 122A, 122B in the preferred embodiment are fixedly attached to the horizontal support member 18 by means of welding. The tee supports 122A, 122B are constructed of plate aluminum sheeting but may be constructed of other rigid materials such as wood or plastic, for example. In another preferred embodiment, the tee supports 122A, 122B are bolted onto the horizontal support member 18.

A hook and loop type locking mechanism 124 is positioned on each tee support 122A, 122B. Each locking mechanism 124 is formed by a first rectangular pad 126 comprised of hooks and a second rectangular pad (not shown) comprised of loops. The first pad 126 and second pad (not shown) are about one quarter of an inch thick and are of substantially the same size.

The first pad 126 is secured to the inner surface 130 of the tee support 122A, 122B located on the side of the tee support 122A, 122B facing inwardly towards the seat (not shown). The second pads (not shown) are secured to the side of the infant chair (not shown).

Each locking mechanism 124 prevents the support bracket 104 from sliding in any direction. In the preferred embodiment, hook and loop type pads are used to prevent the support bracket 104 from sliding. Either a hook type pad or a loop type pad can be attached to the inner surface 130. In the preferred embodiment, a hook type pad 126 is secured to the inner surface 130 of the tee support 122A, 122B with an adhesive.

The tee supports 122A, 122B in the preferred embodiment have at least one snap 132 on each inner surface 13O. The snap 132 consists of a male and female portion. One portion is fixedly attached to the inner surface 130, and the other is attached to the side of the infant seat (not shown). The snap 132 and the hook and loop locking mechanism 124 are both used to secure the support bracket 104 to the infant seat in the preferred embodiment. Either the locking mechanism 124 or the snap 132 may be used individually.

A harness 134 is attached to the central portion of the horizontal support member 18. The harness is fixedly attached in the preferred embodiment by means of a U-shaped nut and bolt fastener 136. The harness extends from the front of the chair, down and under the chair seat towards the rear of the infant seat. The harness 134 continues to extend vertically up the back of the infant seat, terminating at buckles 138A, 138B located on the vertical support members 110A, 110B.

In the preferred embodiment, the harness 134 consists of a nylon belting material, approximately two and one half inches wide. The buckles 138A, 138B in the preferred embodiment are conventional seat belt fasteners. The buckles 138A, 138B are adjustable such that the support bracket 104 may be used on a variety of different sized infant seats.

Although the present invention has been described with reference to preferred embodiments, workers skilled in the art will recognize that changes may be made in form and detail without departing from the spirit and scope of the invention.

What is claimed is:

1. A soft, pliable baby bottle for use as a feeding device for children, wherein the bottle has a soft construction and is substantially deformable in shape, the baby bottle comprising:

a flexible, removable inner liner having one open end for containing a quantity of a liquid;

a soft, elastomeric nipple having an opening for delivering liquid at a limited rate and for preventing spillage;

a bottle wall comprising a flexible, foamed elastomeric material having an annular space for receiving the flexible inner liner; and a seal formed between the bottle wall and the flexible inner liner as well as the nipple and the flexible inner liner, in response to the assembly of said liner and nipple with said wall.

2. The baby bottle of claim 1 wherein the bottle wall is formed from a foamed synthetic elastomer.

3. The baby bottle of claim 2 wherein the bottle wall is formed from polyurethane foam.

4. The baby bottle of claim 2 wherein the bottle wall has an inner surface and an outer surface, and at least one surface is coated with a water repellent synthetic elastomer.

5. The baby bottle of claim 1 wherein the bottle wall is substantially tubular and has a first open end.

6. The baby bottle of claim 5 wherein the bottle wall has a second closed end.

7. The baby bottle of claim 5 wherein the first open end has an outer diameter that is larger than an outer diameter of the bottle wall.

8. The baby bottle of claim 5 wherein the first open end has an outer diameter which is smaller than an outer diameter of the bottle wall.

9. The baby bottle of claim 5 wherein the seal comprises a male tapered cylindrical surface on an outer bottle surface of the bottle wall, and is tapered inwardly towards the first open end, and has an inwardly projecting circumferential groove located on the outer bottle surface between the tapered cylindrical surface and a second end of the bottle wall, proximate the tapered cylindrical surface.

10. The baby bottle claim 1 wherein the flexible inner liner is a plastic bag.

11. The baby bottle of claim 1 wherein the flexible inner liner is disposable.

12. The baby bottle of claim 1 having an open end and wherein the bottle wall has an outer surface and a circumferential groove on the outer surface near the open end, wherein the nipple has an inner surface, a first end, and a tip opposite the first end, wherein the seal includes an inwardly projecting circumferential ring located on the inner surface of the nipple proximate the first end, and wherein the seal further includes a female tapered cylindrical surface on the inner surface of the nipple that tapers inwardly towards the tip, and is located between the circumferential groove and the tip.

13. The baby bottle of claim 1 wherein the seal comprises an inner sealing surface on the nipple, and an outer sealing surface on the bottle wall, wherein the inner sealing surface is shaped to snugly receive the outer sealing surface, and when the flexible inner liner is inserted into the annular space and folded over the outer sealing surface and the inner and outer sealing surfaces are joined a liquid seal is formed between the snugly positioned inner and the outer sealing surfaces.

14. The baby bottle of claim 1 wherein the bottle wall has a first and second end, and includes a soft, pliable tubular sheath which is soft enough to be shock absorbent attached proximate the first end of the bottle wall, wherein the sheath extends over a portion of an outer surface of the nipple.

15. The baby bottle of claim 14 wherein the sheath is an integrally molded portion of the bottle wall.

16. The baby bottle of claim 14 wherein the sheath is formed of a soft, foamed elastomeric material.

17. The baby bottle of claim 14 wherein the sheath is formed of polyurethane foam.

18. The baby bottle of claim 14 wherein the sheath is flexible enough to be capable of being folded away from the nipple and back onto an outer surface of the bottle wall.

19. The baby bottle of claim 1 and further comprising a soft, pliable support structure attached to the bottle wall for connecting the bottle to a bottle holder.

20. The baby bottle of claim 19 wherein the support structure comprises a first and second end, wherein the first end is fixedly attached to the bottle wall at the first end, and the second end is of a size and shape for snug insertion into a cavity of a bottle holder.

21. The baby bottle of claim 19 wherein the support structure has a first and second end, wherein the first end is removably attached to the bottle wall at the first end, and the second end is of a size and shape for snug insertion into a cavity of a bottle holder.

22. The baby bottle of claim 19 having a first end, proximate the seal and a second end opposite the first end, and a bottle axis extending between a point central to the first end and a point central to the second end, wherein the support structure has a first and second end, wherein the first end of the support structure is fixedly attached to the bottle wall and having a support structure axis extending from a point central to the first end of the support structure to a point central to the second end of the support structure, wherein the bottle axis and the support structure axis form an angle of ninety degrees or greater between the first end of the bottle and the second end of the support structure.

23. The baby bottle of claim 19 wherein the support structure comprises a support member having a first and second end, wherein the support member has an axis extending from a point central to the first end to a point central to the second end, wherein the support member has an inner surface which defines a cavity located along the axis of the support member.

* * * * *